United States Patent [19]

Grossman

[11] Patent Number: 4,913,478

[45] Date of Patent: Apr. 3, 1990

[54] GRAIN BIN DOOR BOARD LATCH

[75] Inventor: Rodney B. Grossman, Goshen, Ind.

[73] Assignee: CTB, Inc., Milford, Ind.

[21] Appl. No.: 283,379

[22] Filed: Dec. 12, 1988

[51] Int. Cl.[4] ..... E05C 3/04

[52] U.S. Cl. ..... 292/259 R; 49/465; 292/DIG. 30

[58] Field of Search ..... 292/259, 213, 241, 304, 292/240, DIG. 30; 49/464, 463, 465

[56] References Cited

U.S. PATENT DOCUMENTS

| | | | |
|---|---|---|---|
| 1,330,847 | 2/1920 | Chocker | 49/465 |
| 1,359,702 | 11/1920 | Hockenberry | 292/262 |
| 2,194,230 | 3/1940 | Lewis | 49/464 |
| 2,341,763 | 2/1944 | Craine | 292/218 X |
| 2,550,856 | 5/1951 | Ouellet et al. | 49/465 X |

*Primary Examiner*—Richard E. Moore

*Attorney, Agent, or Firm*—Trexler, Bushnell, Giangiorgi & Blackstone

[57] ABSTRACT

A latch apparatus and a cover member for releasably closing an access opening in a grain bin. The latch apparatus includes a continuous bar which has a gripping section for grasping while opening and closing the cover member, a section for engaging a stud which protrudes from the frame around the perimeter of the opening, and a section on which the bar pivots. The pivot section of the bar rotates within a pivot receptacle which is secured to the cover member.

14 Claims, 4 Drawing Sheets

GRAIN BIN DOOR BOARD LATCH

BACKGROUND OF THE INVENTION

This invention relates to a latching apparatus and a cover door used for removably closing an access opening in a bulk storage structure such as a grain bin.

Large bulk storage containers are commonly used to store grain for drying purposes or in anticipation of favorable market conditions. Such grain bins can be very large structures, up to ninety feet in diameter and fifty feet in height with storage capacity of up to 350,000 bushels. The grain stored in such a bin is capable of exerting substantial forces on the structure of the bin, and it is therefore very important that the structural integrity of the grain bin be maintained, since failure to do so may cause a failure of the structure.

Grain bins are typically large cylindrical structures with conical roofs. These structures are usually constructed of curved corrugated sheet metal panels which are attached to each other using bolts spaced around each edge of overlapping panels to form cylinders. These cylinders are stacked one upon another, forming a single continuous corrugated sheet metal cylinder resting on a circular base. Since much of the structural integrity of this type of structure is dependent upon continuity of the wall surface, it is important to avoid any gaps or breaks in the walls.

Most bulk storage containers of this type require an access opening in the side of the structure. Typically, this access opening permits the insertion of conveyance equipment, drying equipment, or the like, affords access to a repairman for repairs or the like. This access opening creates a structural problem for the bin such that some means must be provided to compensate for the lack of continuous supporting material in the area of the access opening. The solution to this problem in the past has been door covers over the access opening which are structurally integrated into the wall such that when the door covers are in place they act as a structural member of the grain bin. Typically these latching systems have employed tie-rods or locking cams.

When properly used, the tie-rod latching system properly secures the cover door against the access opening. However, the tie-rods are bothersome to use and for this reason they are often removed from the cover door by operating personnel. Further, since the tie-rods are a separate component of the cover door latching system, they can easily be misplaced or misused. Since tie-rods may not always be used, a minor shift or settling of the contents could bulge or spread the access opening when not properly secured by tie-rods, resulting in a critical structural failure.

The locking cam latching system employs a hand operated cam which locks into a side member of the frame around the perimeter of the access opening. This type of latch performs well at holding the cover door in place, and are also attached to the structure, thereby eliminating the possibility of removal by operating personnel. This type of latching system, however, has a disadvantage in that it is difficult and quite often uncomfortable to use. These cam latches usually have a small, thin handle positioned on the outside of the frame member of the access opening, making it difficult to use. Moreover, these cam latches require application of a substantial amount of force in order to properly lock the cover door in place. Since these cam latches are initially difficult or become very difficult to use over a period of time, they are often left unlatched, thereby failing to properly secure the door cover in a position which would provide the structural support necessary to maintain the integrity of the structure. Further, these cam latches are usually complex, multi-piece assemblies, requiring special attachment to the side of the structure.

Yet another latching system is available, which also employs tie-rods. This type of system secures the tie-rods into place through a bolting system. These tie-rods provide substantial security in integrating the door covers to the structure, but they are very difficult to use because they require special tools for removal and replacement. Since these tie-rods require special tools, and quite often these special tools are unavailable as with the cam-latching system and the other tie-rod latching system, this "tool-requiring" tie-rod latching system is often removed from, or simply omitted from the structure during assembly, thereby increasing the risk of structural failure.

A problem common to all of the above-mentioned latching systems is that the difficulties encountered in their operation, for the various reasons mentioned above, often results in failure of the operator to employ any latching apparatus at all.

OBJECTS AND SUMMARY OF THE INVENTION

A general object of this invention is to provide an uncomplicated and easy to operate latching apparatus to removably secure a door for an access opening in a bulk storage structure.

Another object of this invention is to provide a latching apparatus and cover door for an access opening in a bulk storage structure which does not require additional members, such as tie-rods, to structurally integrate the apparatus into the structure.

A further object of this invention is to provide a latching apparatus which requires less force and is more convenient for the user to operate when removing and replacing the cover door than current apparatus.

Yet another object of this invention is to provide a latching apparatus which does not require any tools to open or close.

Still another object of this invention is to provide a latching apparatus which is not independent of the structure, thereby eliminating the possibility of its loss or misapplication.

In accordance with the foregoing objects, the invention comprises a latch apparatus attached to a cover member and a corresponding storage structure for releasably sealing an opening in a bulk storage structure wherein the latch apparatus is comprised of components which are attached to the cover door and the storage structure. Further, this latching apparatus has a minimum number of components providing an uncomplicated latching apparatus. This latching apparatus does not require any additional loose parts or tools to remove or replace the cover door. Additionally, this invention provides a latching apparatus which requires less force and is more comfortable for the user to open or close than current latching apparatus. The apparatus has a grip means which the user grasps and pushes down over locking studs.

Finally, this invention provides a fail-safe mechanism in that the cover door cannot be properly closed unless the latch is used to close the door.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figure 1:
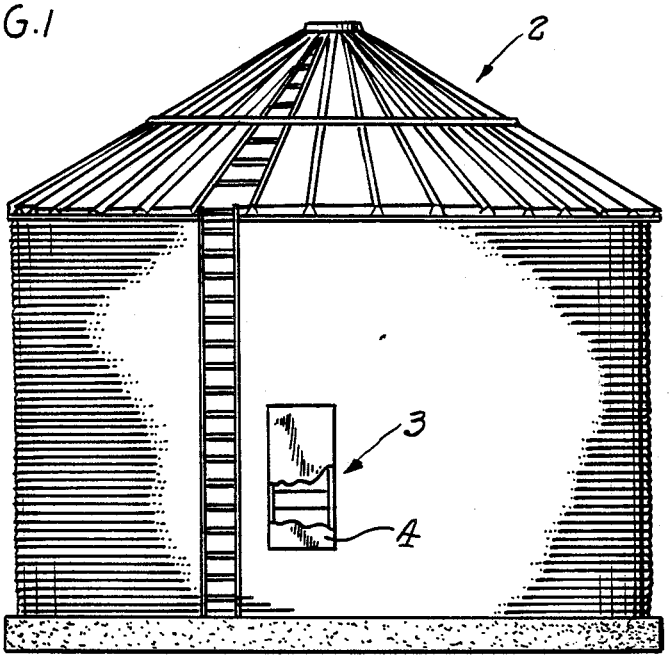
FIG. 1 is an elevational view of a bulk storage structure in which the latch apparatus and cover member of the invention are used to removably seal an opening in the side of the storage structure.

While this invention is susceptible to embodiment in many different forms, there is shown in the drawings and will be herein described in detail, one specific embodiment with the understanding that the present disclosure is to be considered an exemplification of the principles of the invention, and is not intended to limit the invention to the embodiment illustrated.

FIG. 1 shows an elevational view of a bulk storage structure 2, commonly referred to as a grain bin, which has an access opening 4 in its side 3. This access opening 4 affords access to the inside of the structure 2, or the contents of the structure 2, for various purposes. Depending upon the size of the grain bin 2, a typical access opening 4 is usually on the order of 5'×3', creating a substantial opening in the side 3 of such a structure.

Figure 2:
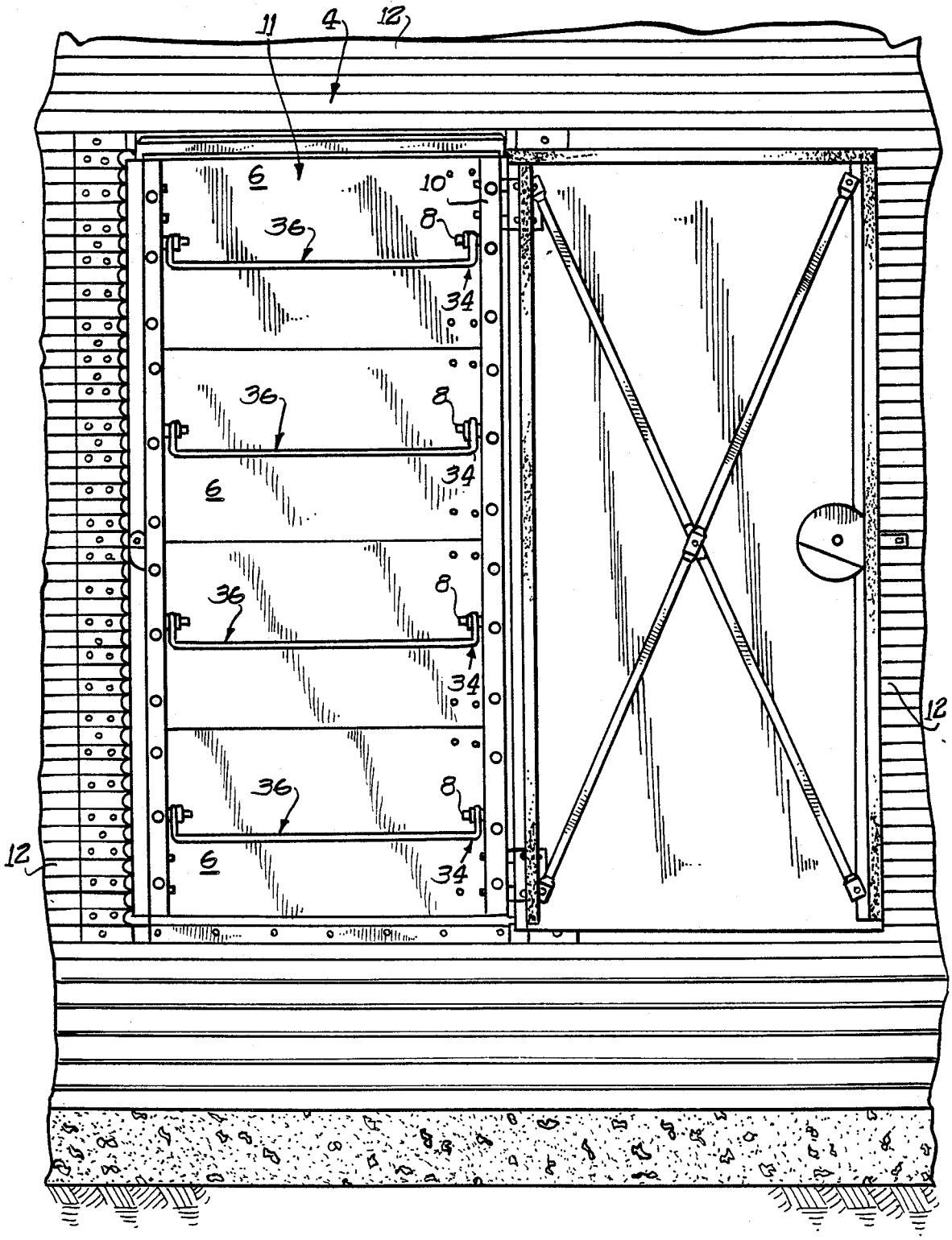
FIG. 2 is an enlarged view of the opening in FIG. 1, providing a detailed illustration of the latch apparatus and cover member of the invention.

FIG. 2 shows an elevation of the outside of the storage structure 2 with cover members 6 and latch apparatus 8 in place thereby sealing the access opening 4. As shown in FIG. 2 several cover members 6 are usually required to seal an access opening 4. In FIG. 2, four cover members 6 and four corresponding latch apparatus 8 are used. The cover members 6 as shown in FIG. 2 abut the frame members 10 from the inside of the structure 2 with access to the latch apparatus 8 from the outside of the structure 2. The cover members 6 in the embodiment herein disclosed are hingedly attached to the frame member 10, thereby minimizing problems such as loss or damage by removal or misplacement of the cover member. An alternative embodiment provides for cover members which are detachable from the structure 2, also within the scope of the invention.

Figure 3:
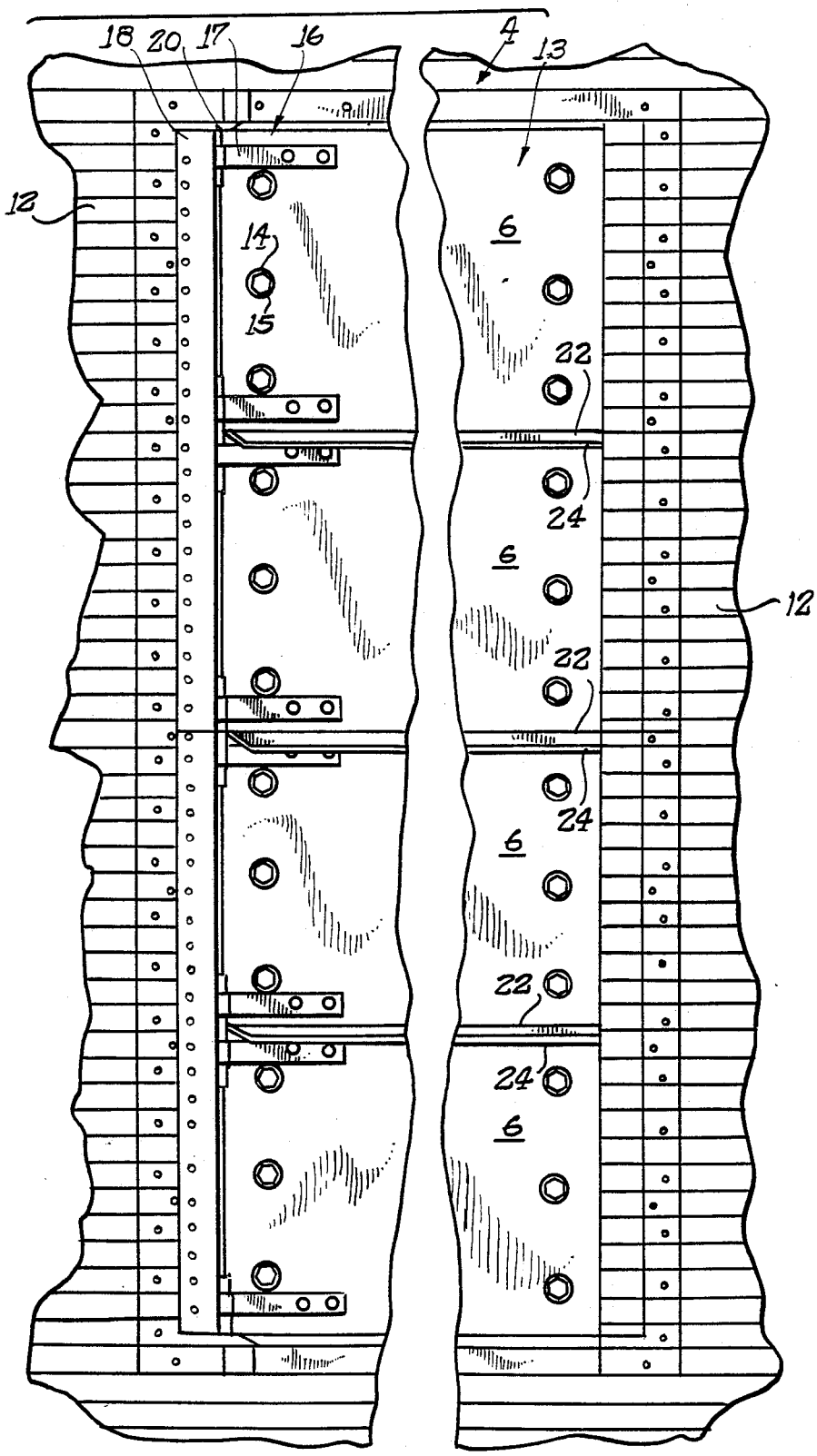
FIG. 3 is a view of the detailed illustration of the latch apparatus and cover members shown in FIG. 2 from the inside of the storage structure shown in FIG. 1.

FIG. 3 shows the cover members 6 as viewed from the inside of the structure 2. The laterally outwardly facing surface 11 of the cover member 6 abut the laterally inwardly facing surface 13 of the frame member 10, which is secured to the sidewall 12. In an alternative embodiment the sidewall 12 is formed to create an integral frame member 10 thereby eliminating the need for separate frame member structure 10.

Figure 4:
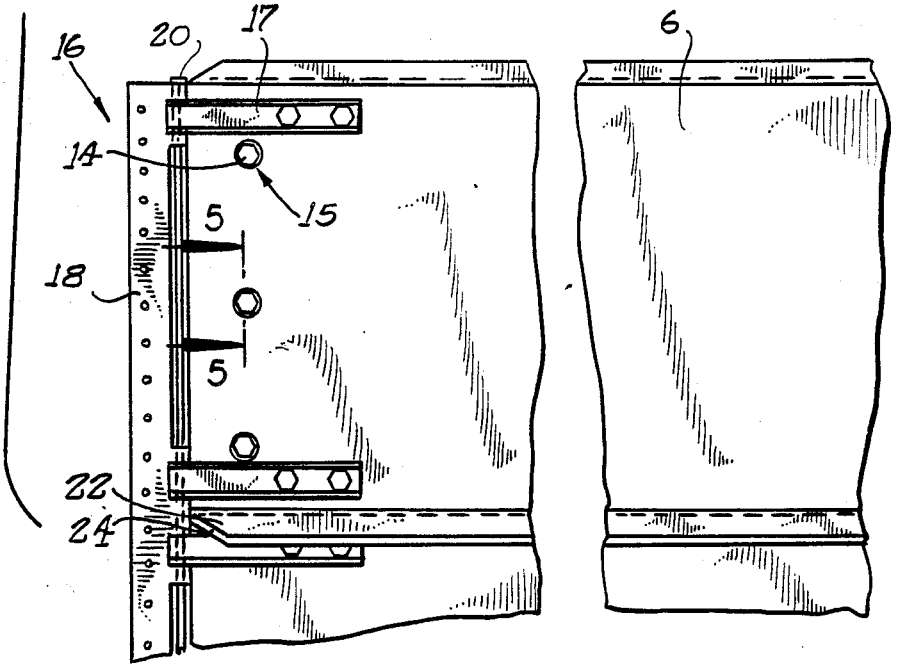
FIG. 4 is a close-up of one of the cover members shown in FIG. 3.
Figure 5:
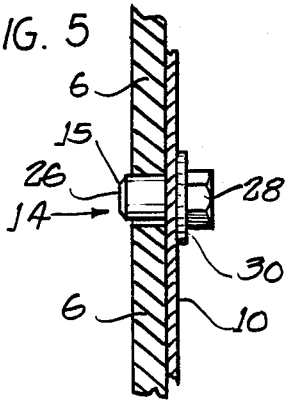
FIG. 5 is a view of cross-section 5—5 in FIG. 4, showing a cover member of the invention positioned over a cap screw which is mounted to the edge of the opening in the bulk storage structure.

As best viewed in FIGS. 4 and 5, the cover members 6 are positioned over and engaged with cover engaging protuberant members 14. While the size, shape, method of attachment, structure, location and orientation of the cover protuberant members 14 may vary within the scope of the invention, the purpose of these members remain the same. The cover protuberant members 14 function to secure and align the cover members 6 in a desired position and prevent vertical and horizontal movement, or a combination of both, relative to the sidewalls 12. More specifically, the members 14 interengage the cover members 6 at opposite sides of the opening 4, so that the cover members 6 in effect become tie-rods or tension members holding the opposite sides of the frame member 10 together when the sidewall of the bin is stressed under a load of grain or the like.

The present invention uses six protuberant members 14 in securing each cover member 6, three protuberant members 14 mounted to each vertical frame member 10 on each side of the access opening 4. Three bores 15 are positioned on each vertical edge of the cover member 6 corresponding to the position of the protuberant members 14. The bores 15 can be through hole bores or merely partial bores depending upon the design of the cover protuberant members 14 and cover member 6. The illustrated embodiment uses a complete through hole design which reduces the possibility of misalignment of the cover members 6 due to plugging of the bores 15 by foreign material.

In the illustrated embodiment, each cover protuberant member 14 comprises a cap screw 26 and a washer 30 secured by a nut 28. Additionally, as best viewed in FIG. 5, in the illustrated embodiment, the top edges of the cap screws 26 are chamfered to facilitate interengagement therebetween when the bore 15 is engaged with the cap screw 26.

Figure 6:
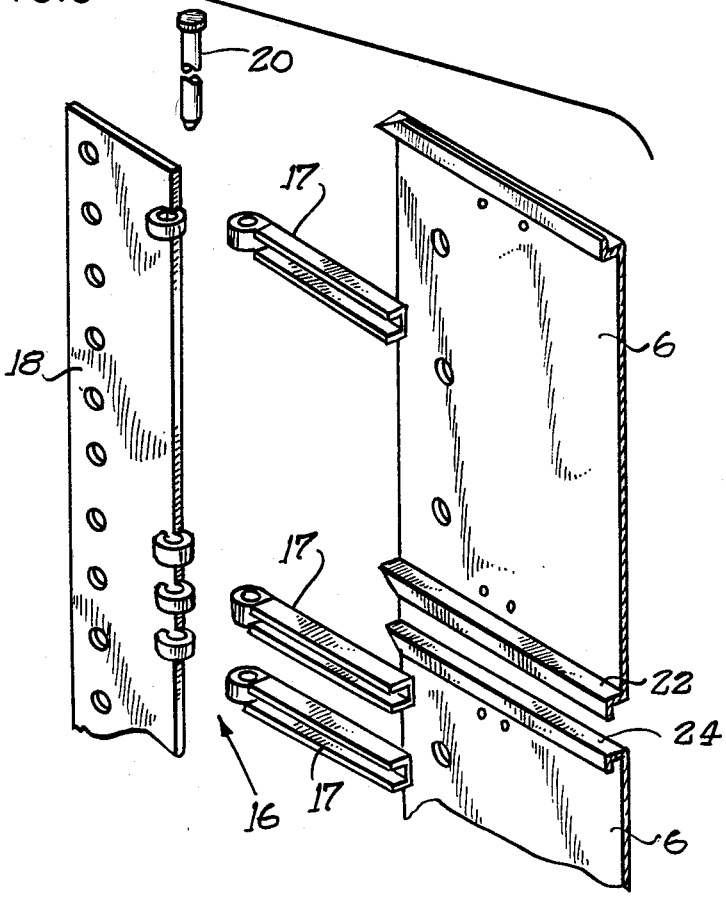
FIG. 6 is an exploded view of the elements of the cover member of the invention and hinge means shown in FIG. 4.

As previously noted the cover member 6 in the illustrated embodiment is hingedly attached to the frame member 10 by hinge means 16. Referring to FIG. 6, the hinge means 16 in the present invention include a hinge strap 17 attached to the cover member 6, a hinge plate 18 attached to the frame member 10, and a hinge pin 20 movably connecting hinge plate 18 to hinge strap 17. The illustrated embodiment employs a pair of hinge straps 17 attached to each cover member 6. The hinge plate 18 of the illustrated embodiment is preferably a continuous member which is attached to the frame member 10. This tends to increase the structural integrity of the access opening 4, adding more strength and support to the frame member 10.

As best viewed in FIG. 6, at the top and bottom of each cover member 6 shown in FIG. 3 a top sealing flange 24 and a bottom sealing flange 22, are respectively provided, and preferably integrally formed thereupon. These flanges 22, 24 seal the space between the cover members 6 to prevent escape of material stored in the structure 2, or entry of any material or pests. One such bottom sealing flange 22 extends from the bottom of its associated cover member 6 and angled downwardly and outwardly of cover member 6 and toward the inside of the structure 2. Top flange 24 extends from the top of the same cover member 6 and is angled upwardly and outwardly of cover member 6 towards the inside of the structure 2. The inward and outward angles of the flanges 22, 24 alternate relative to their associated cover members to create a downward mated seal.

Figure 7:
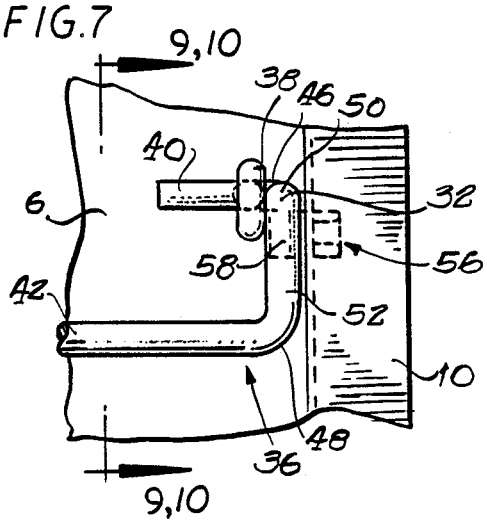
FIG. 7 is a detail of a locked latch apparatus showing hook means engaged with a stud which is mounted to the edge of the opening in the bulk storage structure.
Figure 9:
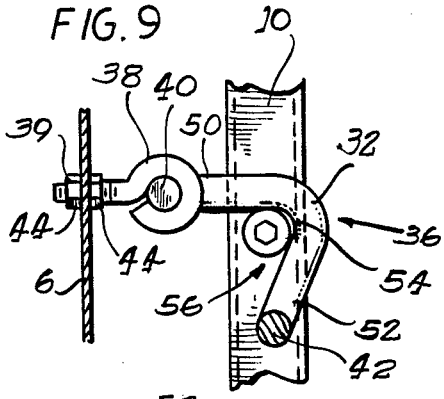
FIG. 9 is a view of cross-section 7—7 in FIG. 7, illustrating a latch apparatus of the invention in a locked position.

FIGS. 7, 8, 9 and 10 provide a detailed showing of the structure and operation of the latch apparatus 8. FIG. 7 is an enlarged view corresponding to the right side structure 34 of one of the latch apparatus 8 shown in FIG. 2, showing further details of the latch apparatus 8 in a locked position.

In the illustrated embodiment the latch apparatus 8 comprises several components including: latch bar means 36, pivot receptacle 38 and latch protuberant means 56. Latch bar means 36 comprises several distinct features including pivot portions 40, hook means 32, and grip means 42. While the latch bar means 36 is here shown as a continuous bar, it is apparent that an alternative design could include a multi-member latch bar means 36.

In the following description of the latch apparatus, it will be understood that only one side is shown in FIGS. 7, 8, 9 and 10 and since the sides are symmetrical, the description is intended to apply to the side not shown as well.

Latch bar means 36 is constructed with grip means 42 in a parallel orientation to pivot portions 40. A frame end 46 of the pivot portion 40 shown in FIG. 7 is attached to a cover end 50 of the hook means 32. Further, a frame end 48 of the grip means 42 is attached to a down end 52 of the hook means 32. Both the pivot portions 40 and the grip means 42 perpendicularly attach to the hook means 32. The hook means 32 is formed by an acute angular bend 54 in the latch bar means 36. Hook means 32 is designed to engage the stud 58 of latch protuberant means 56. As noted above, for clarification, the pivot portion 40 and grip means 42 attach to the cover and down ends 50, 52 respectively of the hook means 32 in a perpendicular orientation to the plane in which the acute angle 54 is formed.

The latch bar means 36 is rotatably attached to the cover means 6 by the pivot portions 40 which project through the pivot receptacles 38 which are attached to the cover member 6. In the present embodiment the pivot receptacles 38 comprise what are commonly known as eye-bolts. The pivot receptacles 38 are mounted through a hole 39 in the surface of the cover means 6 and secured by a pivot receptacle nut 44.

Figure 8:
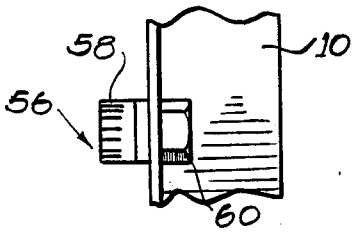
FIG. 8 is an unobstructed detailed view showing a latch protuberant member mounted to the edge of the access opening in the bulk storage structure.

FIG. 8 shows in detail, one of the latch protuberant means 56 which are used in securing the latch bar means 36 in a locked position. While the structure of the latch protuberant means 56 is very similar to the cover protuberant means 14, the latter is formed with chamfered edges to facilitate ease of engagement with cover member 6. In contrast, as shown in FIG. 8, the latch protuberant means 56 is comprised of stud 58 which is held in mounted position in frame member 10 by stud nut 60. The stud 58 differs from cap screw 26 in that the head of the stud 58 can be shaped to resist separation of the stud from the hook means 32.

Figure 10:
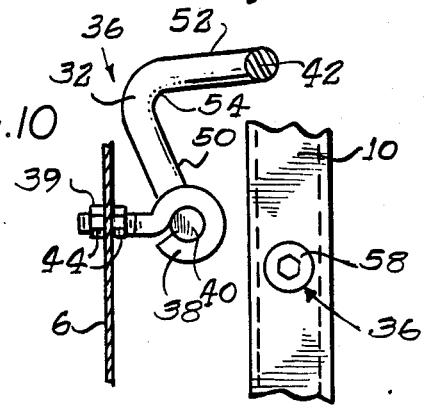
FIG. 10 is a view of cross-section 7—7 in FIG. 7, illustrating a latch apparatus of the invention in an unlocked position.

FIG. 10 shows the latch apparatus as described above, with the latch bar means 36 raised in the unlocked position, thereby disengaging hook means 32 from the latch protuberant means 56.

In application, a user standing on the outside of the structure 2, positions himself in front of the access opening 4. To open one of the cover members 6, the user unlocks the latch apparatus 8 by grasping the grip means 42 and lifting the latch bar means 36 upwardly. The upward lifting force on the latch bar means 36 disengages the hook means 32 from the stud 58. Once the hook means 32 is disengaged from the stud 58, the pivot portions 40 freely axially rotates within the pivot receptacles 38. Once the latch bar means 36 is lifted high enough to clear the top of the stud 58, the cover means 6 is pushed inwardly into the structure 2. Upon pushing inwardly on the cover means 6, the user disengages the bores 15 from the cap screws 26 of the cover protuberant means 14. With continued inward pressure the cover means 6, to which the latch apparatus 36 is attached, rotates about its hinged edge on hinge means 16 which are attached to the cover means 6 and to the frame member 10.

To close the cover means 6, the user reaches into the structure 2 and grasps the latch bar means 36 by the grip means 42 and pulls the cover means 6 toward the outside of the structure 2. The cover means 6 rotates about its hinged edge on hinge means 16. While pulling the cover means 6 toward the outside of the structure 2, the user must raise the latch bar means 36 slightly to clear the top of the stud 56. Once the latch bar means clears the top of the stud 56, the user must pull the cover means 6 so that the outside surface of the cover means 6 abuts the inside surface of the frame member 10, thereby engaging the bores 15 with the cap screw 26 of the cover protuberant means 14. Having engaged the bores 15 with the cap screws 26, the user grasps the grip means 42 and pushes downward. This downward force rotates the pivot portions 40 within the pivot receptacles 38. The user continues to exert this downward force when the hook means 32 contact the stud 56, thereby engaging these components.

While a preferred embodiment of the present invention is shown and described, it is envisioned that those skilled in the art may devise various modifications without departing from the spirit and scope of the appended claims.

The invention is claimed as follows:

1. A latch apparatus for releasably securing a cover member over an access opening in a bulk storage structure which structurally integrates the cover member into the storage structure for improving the structural integrity of the storage structure, said latching apparatus comprising: cover protuberant means projecting from a surface of said bulk storage structure for releasably retainably engaging corresponding cover protuberant means engaging bores formed in an overlying surface of said cover member, said cover member extending between at least two opposed edges of said access opening, said cover protuberant means being releasably retainably engagable with said bores for transferring forces on said access opening through said cover member; pivot receptacle means attached to said cover member; latch bar means operationally connected to said pivot receptacle means for movement between latching and releasing positions; and latch protuberant means mounted to an edge of said access opening for engaging said latch bar means in said latching position to hold said cover member in position.

2. A latch apparatus according to claim 1, wherein said latch bar means comprises: pivot portion means formed on said latch bar means and movably attached to said pivot receptacles; hook means formed on said latch bar means and operationally connected to said pivot portion means for engaging said latch protuberant means; and grip means formed on said latch bar means and connected to said hook means for grasping while manually operating said latch apparatus.

3. A latch apparatus according to claim 2, wherein said latch bar means comprises a continuous bar.

4. A latch apparatus according to claim 3, wherein said grip means and pivot portion means are substantially parallel to each other, said grip means including an elongated section of said latch bar, said hook means comprising acute angular bends in said latch bar extending between said grip means and said pivot portion means, and said hook means being releasably engageable with said latch protuberant means upon rotation of said latch bar about said pivot portion means.

5. A latch apparatus for closing an access opening in a bulk storage structure which structurally integrates the cover member into the storage structure for improving the structural integrity of the storage structure, said latching apparatus comprising: cover means for extending between opposite sides of said access opening, said cover member having cover protuberant means engaging bores formed therethrough; cover protuberant means projecting from an edge of said access opening for engaging said cover protuberant means engaging bores when said cover member is positioned overlying said cover protuberant means and in access opening-covering engagement with said bulk storage structure; pivot receptacle means attached to said cover means; latch bar means operatively coupled to said pivot receptacle means; and latch protuberant means mounted to an edge of said access opening for engaging said latch bar means to hold said cover means in position covering said access opening.

6. An apparatus according to claim 5, wherein said latch bar means comprises an elongate single piece bar including: pivot portions formed on opposite ends of said latch bar and movably attached to said pivot receptacle means; hook means formed on latch bar medial portions for engaging said latch protuberant members; and grip means formed on said latch bar medial portions for manual grasping while manually operating said latch bar means.

7. An apparatus according to claim 5, wherein said latch bar means comprises a continuous bar including: substantially parallel grip means and pivot portions; said grip means including an elongated medial section of said bar; hook means comprising acute angular bends in said continuous bar extending between a medial portion of said pivot portions and a distal portion of said grip means; said pivot portions being formed at the distal opposite ends of said continuous bar; and said latch protuberant means being mounted along opposite edges of said access opening generally perpendicular to said cover means, said latch protuberant means engaging said hook means when said latch bar is moved into a latching position to releasably hold said cover member in position covering said access opening in said bulk storage structure.

8. A latch apparatus according to claim 5, and further including hinge means for connecting said cover member to said bulk storage structure and wherein said cover member hingedly moves on said hinge means to releasably engage at least one cover protuberant means mounted on a surface which said cover member abuts.

9. A latching apparatus for releasably securing a cover member to removably close an access opening in a bulk storage structure, said cover member being removably integratable into said storage structure to improve the structural integrity of the storage structure, said latching apparatus comprising: cover protuberant means engaging bores formed on an abutting surface of said cover member; cover protuberant means attached to said storage structure for releasably engaging said cover protuberant means engaging bores, hinge means attached to said cover member and to said storage structure for hingedly connecting said cover member to said storage structure; pivot receptacle means attached to said cover member for pivotally attaching latch bar means to said cover member; said latch bar means being operationally attached to said pivot receptacle means for providing a mechanical advantage in closing said cover member over said access opening; and latch protuberant means mounted to an edge of said access opening for engaging said latch bar means when closing said cover member over said access opening and for retaining said cover member thereover.

10. A latching apparatus according to claim 9 wherein said cover protuberant means are attached to said storage structure on an inside inwardly facing surface of said storage structure generally along the edges of said access opening.

11. A latching apparatus according to claim 10 wherein said cover protuberant means is transversely continuous, free of enlargements and formed having a circular cross-section.

12. A latching apparatus according to claim 10 wherein said cover protuberant means is transversely continuous, generally free of enlargements and formed having a non-circular cross-section.

13. A latching apparatus according to claim 10 wherein said cover protuberant means engaging bores are formed through said cover member.

14. A latch apparatus according to claim 10 wherein said cover protuberant means are attached to said storage structure to project away from said storage structure in a generally perpendicular orientation to said in side surface.

* * * * *